US005247821A

United States Patent [19]

Bertoli

[11] Patent Number: 5,247,821

[45] Date of Patent: Sep. 28, 1993

[54] EXTRUDING PRESS AND METHOD FOR ITS FEEDING

[75] Inventor: Domenico Bertoli, Rodengo Saiano, Italy

[73] Assignee: OMAV S.p.A., Rodengo Saiano, Italy

[21] Appl. No.: 706,962

[22] Filed: May 29, 1991

[30] Foreign Application Priority Data

Oct. 23, 1990 [IT] Italy ..... 5225 A/90

[51] Int. Cl.[5] ..... B21C 23/00; B21C 33/00

[52] U.S. Cl. ..... 72/255; 72/263; 72/270; 100/39; 100/41

[58] Field of Search ..... 100/35, 39, 41, 94, 100/95, 215, 218; 72/255, 263, 270

[56] References Cited

U.S. PATENT DOCUMENTS

| | | | |
|---|---|---|---|
| 2,539,564 | 1/1951 | Barrett | 72/255 |
| 3,228,226 | 1/1966 | Elger | 72/263 |
| 3,559,443 | 2/1971 | Petsch | 100/214 |
| 3,738,144 | 6/1973 | Doudet | 72/263 |
| 4,056,964 | 11/1977 | Shibasaki | 72/263 |
| 4,165,625 | 8/1979 | Wagner | 72/255 |
| 4,326,399 | 4/1982 | Doudet | 72/255 |
| 4,342,212 | 8/1982 | Sibler | 72/263 |

FOREIGN PATENT DOCUMENTS

| | | | |
|---|---|---|---|
| 0636744 | 10/1936 | Fed. Rep. of Germany | 72/270 |
| 2511295 | 9/1976 | Fed. Rep. of Germany | 72/270 |
| 0037485 | 10/1981 | Fed. Rep. of Germany | 72/255 |
| 8803066 | 5/1988 | Italy | 72/270 |
| 0326008 | 8/1989 | Italy | 72/255 |
| 0109520 | 7/1982 | Japan | 72/255 |

*Primary Examiner*—Timothy F. Simone
*Assistant Examiner*—Randall E. Chin
*Attorney, Agent, or Firm*—McGlew and Tuttle

[57] ABSTRACT

A method for feeding billets in horizontal extruding presses which comprises the opening of the container, the cutting off of the surplus of the billet extruded simultaneously to the supplying of a new billet in line with the container and to a simultaneous withdrawal of the press shank after each extruding operation and with the withdrawl of the main piston; then the advancing of the pusher for the insertion of a new billet into the container which is still open and the simultaneous withdrawal of the billet shear and of the feeder means for the supplying of the billet; the closing of the container when the pusher retracts and the movement of the press shank on the axis of the container; finally the advancing of the main piston for the inserting of the press shank into the container for the extrusion operation.

6 Claims, 2 Drawing Sheets

EXTRUDING PRESS AND METHOD FOR ITS FEEDING

FIELD OF THE INVENTION

The present invention relates to extruding presses for structures in aluminum, light alloys, copper and brass and in particular relates to a method for feeding starting billets into these presses. The present method is especially applied to horizontal extruding presses with a die and with a container having a cylindrical cavity on a horizontal axis with a mouth piece for the insertion of the billet with the help of a pusher.

BACKGROUND OF THE INVENTION

Certain extruding presses are provided with a pusher for the inserting of the billets into the container of the press and with a main piston for the controlling of a press shank which pushes the billets towards the die during the extruding process. Extruding presses, are already known from the prior art, which use an extended pusher on the extruding axis placed in, and retractable inside, the main piston whilst the press shank is fitted on a movable slide on the piston in a transversal direction to that of the extruding axis. This is so as to move the press shank away from the axis of the container in order to feed a new billet and to insert it inside the container through the advancing pusher.

In these presses the billet is usually inserted inside the container when the latter is already closed against the die and after the shearing off the surplus of the billet previously extruded. The sequence of movements of the container, of the billet shear, of the press shank and of the exit/re-entry of the pusher in relation to the feeding, inserting and extruding of the billet is however such so as to lead to notable dead or passive periods between one phase and the other, thus bearing negatively upon the actual efficiency of the press.

A press, in which even the pusher, like the press shank, is fitted onto a movable slide controlled according to a transversal direction to that of the extruding axis has been proposed in a bid to reduce these dead periods. Even in this type of realization notable dead periods which do not allow for a complete exploitation of the potential of the press are still present.

SUMMARY AND OBJECTS OF THE PRESENT INVENTION

The present invention aims to solve the problem of the dead periods in these presses by drastically reducing them through a more consonant sequence in the movements of the operational parts of the machine in relation to the feeding and inserting of the billets into the container. It is precisely and object of the present invention to propose a new and original method for the feeding of the billets in extruding presses of the type having an extended pusher inside the main cylinder, on the axis of the container and of extrusion; a press shank movable in a transversal direction to that of the extruding axis; a billet shear between the container and die; and a billet feeder. After each extruding operation and with the main piston withdrawing the method has the steps of, the opening of a die side of the container, the shearing of the surplus of the billet previously extruded together with the supplying of a new billet aligned to the container and a simultaneous movement of the press shank at a right angle to the axis of the press; the advancement of the pusher for the insertion of the new billet into the container which is still open on the die side and the simultaneous withdrawal of the billet shear and of the supplying means of the billet; movement of the container to close the die side after the re-entry of the pusher and after the press shank has been moved in line with the container; and finally the advancement of the main cylinder for the insertion of the press shank into the container for the extruding operation.

The here proposed method is applicable to both new presses, with a notable reduction of the dead periods, therefore improving their productivity and to old presses as a modification, again to reduce the dead periods as well as to allow for an extrusion of billets longer than the ones foreseen in the initial projects of the original machine.

The possibility of extruding longer billets reduces the amount of waste from the shearing of the extruded parts. Furthermore, the press with a movable press shank is more compact with respect to traditional presses when considering billets to be extruded of the same length.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DETAILED DESCRIPTION OF THE PREFERRED EMBODIMENT

Figure 1:
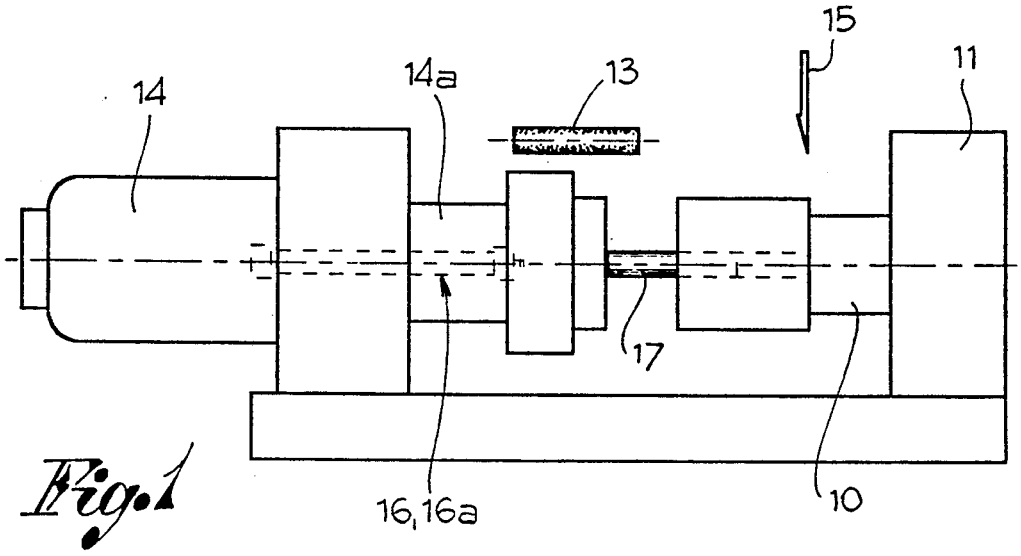
FIG. 1 is a side view of the extruding press in operation.

Referring to the drawings and in particular to FIG. 1, the extruding press comprises a die 10 with a horizontal axis which is fitted on a relative slide 11 on the axis of said die, a container 12 with a cavity 12*a* designed to receive the billet to be extruded 13 and a main pressing piston 14*a* operating in a corresponding cylinder 14 and assisted by lateral pistons (not shown). A billet shear 15 is fitted between the die 10 and the container 12 for the final shearing of any surplus of previously extruded billets. Within the main piston 14*a* and aligned to said container there is fitted a cylinder 16 with an outgoing and retracting pushing rod 16*a*. The cylinder 16 and pushing rod 16*a* is designed to insert the billet 13 into the cavity 12*a* of the container 12. A pressing shank 17 is fitted at the head of the main piston 14. The pressing shank 17 is movable in line to and out of line, by sideways, upwards or downwards movement with respect to the extruding axis. The pressing shank is designed to enter inside the cavity 12*a* of the container 12 when the pressing piston 14*a* advances during the extrusion operation of each billet 13.

Figure 6:
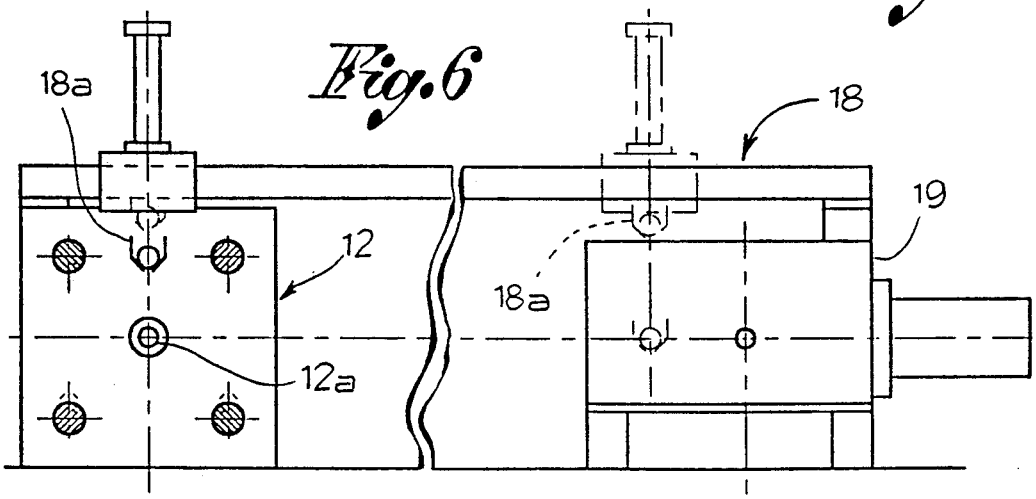
FIG. 6 is a view of the feeder in a transversal direction to that of the press.

As shown in FIG. 6, a feeder 18 with grippers 18*a* lifts and transfers each billet 13 starting from a hot shearing 19. The feeder 18 lifts and transfers each billet 13 up to the level of the press. The feeder 18 is arranged in a transversal direction to that of the extrusion axis in a position between the retracted main piston and the open container 12.

During the extrusion of a billet which has been fed into the container 12, the container 12 is movable to close the die side against the die 10. The press shank 17 is on the axis of the container 12 and the main piston 14*a* moves forward pushing the press shank 17 into the cavity 12*a* of the container for the extruding operation. This condition is represented in FIG. 1 where it can be noted that the billet shear 15 is then in an inoperable position, that the rod 16*a* is withdrawn inside the main piston 14*a* behind the press shank and that the new billet 13 is near the press ready to be fed.

Figure 2:
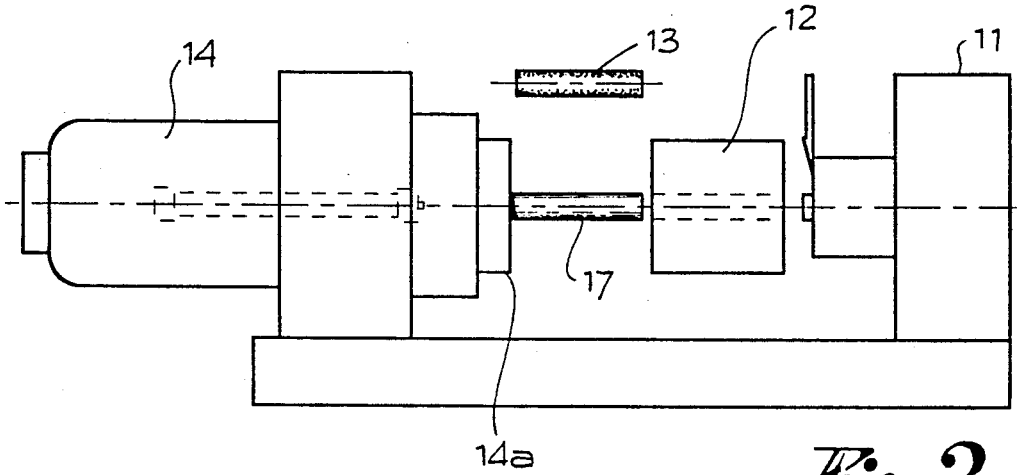
FIG. 2 is the same view as in FIG. 1 with the container open and in the position to begin shearing, to move the press shank sideways and away, and to supply a new billet.
Figure 3:
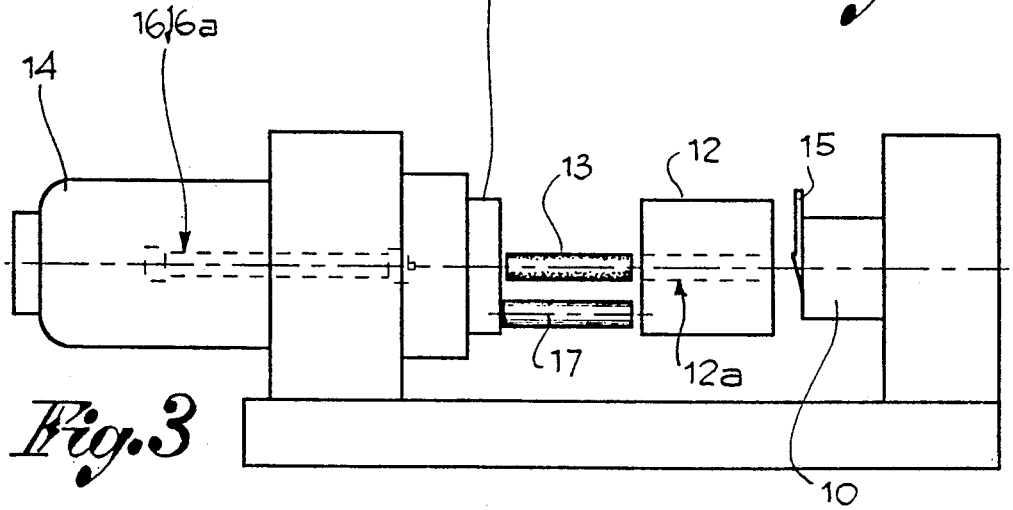
FIG. 3 is again the same view as the one in FIG. 1 with the billet shear in the operating position, the press shank not in line with the container and the new billet in line with the latter.
Figure 4:
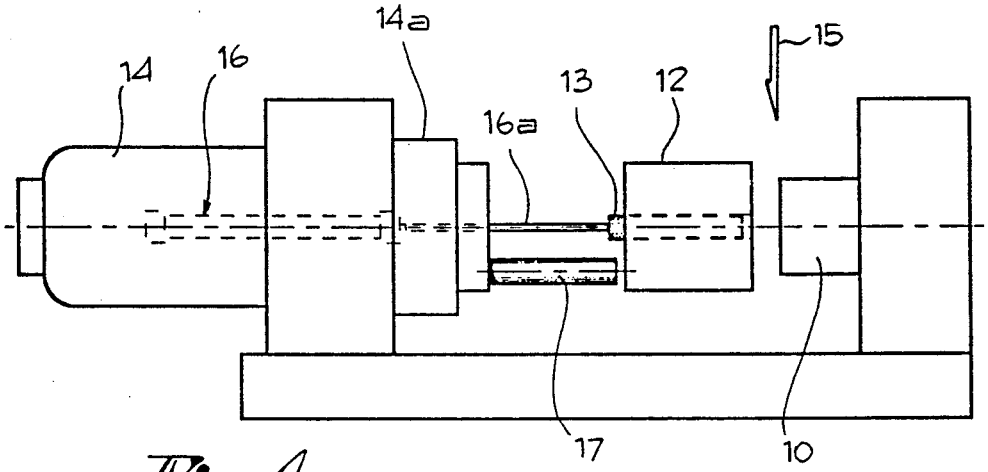
FIG. 4 shows the press during the withdrawal phase of the billet shear and the supplying parts of the new billet and the inserting phase of the billet into the container.
Figure 5:
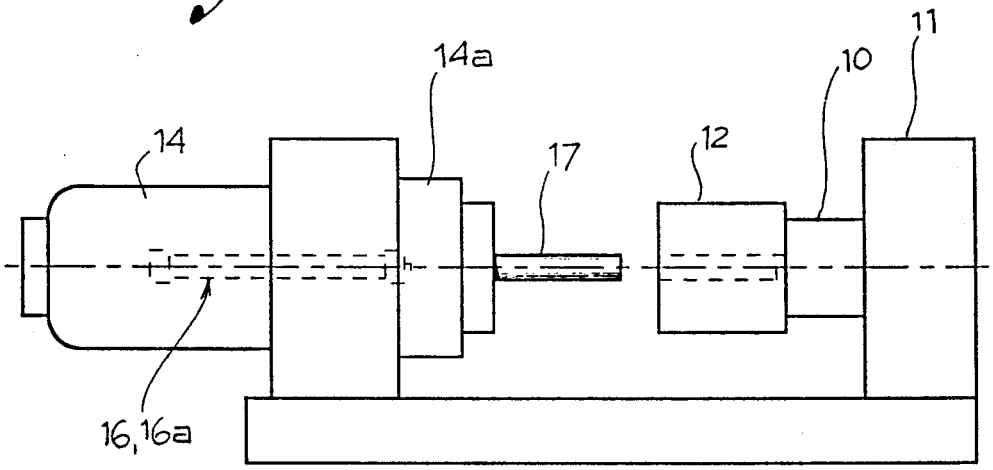
FIG. 5 shows the press in position to start operating on the new billet.

After the extrusion, with simultaneous movements, the main piston 14*a* retracts, withdrawing the press shank 17 from the container 12; the container 12 moves away from the die thus opening the die side of the container 10; the billet shear 15 moves towards its operating position (FIG. 2). At this point, the surplus of the billet extruded previously is cut off by the billet shear 15. Simultaneously, the press shank 17 is moved to a side, either above or below with respect to the extruding axis, freeing the channel of the pusher rod 16*a* and, at the same time, the gripping parts 18*a* of the feeder 18 bring a new billet 13 into the space between the head of the main piston 14*a* and the open die side of the container 12 on the extruding axis (FIG. 3). The pusher rod 16*a* then moves forward to insert the new billet 13 into the cavity 12*a* of the container 12 which still has its die side open (FIG. 4), in the meantime the billet shear 15 is withdrawn and the gripper parts 18*a* of the feeder retract to get another billet. Finally, whilst the container 12 moves toward the die 10 to close the die side, the pusher rod 16*a* re-enters the main piston 14*a* and the press shank 17 is repositioned on the axis of the container 12 (FIG. 5). Under these conditions the press can start a new extruding operation, repeating the above mentioned sequences once a new billet to be extruded is inserted.

It is obvious how the contribution and/or the superimposition of the movements of the different operating members of the press allow to reduce the dead periods, thus increasing the production of the press with the advantage of being able to clearly improve the performance of even old presses.

While a specific embodiment of the invention has been shown and described in detail to illustrate the application of the principles of the invention, it will be understood that the invention may be embodied otherwise without departing from such principles.

I claim:

1. An extruding method comprising the steps of: providing a direct press assembly;

moving a container of said direct press assembly away from a stationary die of said direct press assembly;

moving a shear of said direct press assembly against said die and between said die and said container, said moving of said shear shearing off a surplus from said die, said surplus being left over from an extruded billet;

supplying a new billet with a feeder moving said new billet to an area between a main piston of said direct press assembly and said container, said supplying of said new billet being during said moving of said shear against said die and said shearing off;

providing a pusher extendable from and retractable into an inside of said main piston, said pusher being positioned substantially along a longitudinal axis of said main piston;

advancing said pusher of said direct press assembly out of said main piston and moving said new billet into said container;

removing said shear from said die during said advancing of said pusher;

removing said feeder from between said main piston and said container during said advancing of said pusher;

retracting said pusher from said container;

moving said container toward said die during said retracting of said pusher;

moving a press shank of said direct press assembly into substantial alignment with an axis of said container; and moving said main piston toward said die and moving said press shank into said container and extruding said new billet through said die.

2. A method in accordance with claim 1, further comprising:

removing said main piston away from said die after said extruding of said new billet, said removing of said main piston being during said moving of said container away from said die.

3. A method in accordance with claim 1, further comprising:

removing said main piston away from said die after said extruding of said new billet, said removing of said piston being during said moving of said shear against said die and said shearing off.

4. A method in accordance with claim 1, further comprising:

moving said press shank away from said axis of said container during said supplying of said new billet.

5. A method in accordance with claim 4, wherein:

said moving of said press shank away from said axis of said container is in a direction substantially perpendicular to said axis of said container.

6. An extruding method comprising the steps of:

providing a direct press assembly;

moving a container of said direct press assembly away from a stationary die of said direct press assembly;

moving a shear of said direct press assembly against said die and between said die and said container, said moving of said shear shearing off a surplus from said die, said surplus being left over from an extruded billet;

supplying a new billet with a feeder moving said new billet to an area between a main piston of said direct press assembly and said container, said supplying of said new billet being during said moving of said shear against said die and said shearing off;

providing a pusher extendable from and retractable into an inside of said main piston, said pusher being positioned substantially along a longitudinal axis of said piston;

advancing said pusher of said direct press assembly out of said main piston and moving said new billet into said container;

removing said shear from said die during said advancing of said pusher;

removing said feeder from between said main piston and said container during said advancing of said pusher;

retracting said pusher from said container;

moving said container toward said die during said retracting of said pusher;

moving a press shank of said direct press assembly into substantial alignment with an axis of said container;

moving said main piston toward said die and moving said press shank into said container and extruding said new billet through said die;

removing said main piston away from said die after said extruding of said new billet, said removing of said main piston being during said moving of said container away from said die and during said moving of said shear against said die and said shearing off; and moving said press shank away from said axis of said container during said supplying of said new billet.

* * * * *